United States Patent [19]

Krawiec et al.

[11] Patent Number: 4,792,276

[45] Date of Patent: Dec. 20, 1988

[54] TURBOMACHINERY DEBRIS REMOVER

[75] Inventors: Donald F. Krawiec, Pittsburgh; Robert J. Kraf, North Huntingdon; Robert J. Houser, Monroeville, all of Pa.

[73] Assignee: The United States of America as represented by the United States Department of Energy, Washington, D.C.

[21] Appl. No.: 99,812

[22] Filed: Sep. 22, 1987

[51] Int. Cl.[4] ..... F01B 25/26

[52] U.S. Cl. ..... 415/118; 415/201; 15/1; 15/105

[58] Field of Search ..... 415/201, 118, 121 R; 29/166.8 H; 294/66.2; 165/11.2; 901/21, 47; 15/1, 105

[56] References Cited

U.S. PATENT DOCUMENTS

| | | | |
|---|---|---|---|
| 4,231,419 | 11/1980 | Gugel | 165/11.2 |
| 4,253,697 | 3/1981 | Acosta | 294/115 |
| 4,702,878 | 10/1987 | Klug et al. | 165/11.2 |

FOREIGN PATENT DOCUMENTS

| | | | |
|---|---|---|---|
| 4964 | 1/1978 | Japan | 294/66.2 |
| 0779068 | 11/1980 | U.S.S.R. | 294/66.2 |

*Primary Examiner*—Robert E. Garrett
*Assistant Examiner*—Therese M. Newholm
*Attorney, Agent, or Firm*—William W. Randolph; Judson R. Hightower; Richard E. Constant

[57] ABSTRACT

An apparatus for removing debris from a turbomachine. The apparatus includes housing and remotely operable viewing and grappling mechanisms for the purpose of locating and removing debris lodged between adjacent blades in a turbomachine.

10 Claims, 2 Drawing Sheets

TURBOMACHINERY DEBRIS REMOVER

The United States Government may have rights in this invention pursuant to contract DE-AC11-76PN00014 between the U.S. Department of Energy and Westinghouse Electric Corporation.

BACKGROUND OF THE INVENTION

The present invention relates to a debris remover and more specifically to an improved debris locator and remover for debris or foreign material located in the bladed region of a turbomachine.

Infrequently, debris or other foreign material is transported into the bladed region of a turbomachine. If the debris becomes lodged between stationary and rotating blades, damage to the turbomachine may be caused. Therefore, it is important not to operate the turbomachine until the debris is removed.

There are various methods and devices known in the art for locating and/or removing debris. One present method for locating and removing debris lodged between adjacent blades of a blade cascade in a turbomachine is to raise or remove the bladed rotor from the turbomachine casing in order to gain sufficient access to the remainder of the machine. By removing the bladed rotor, an operator can visually locate and remove the debris. For large turbomachines, this known method requires lengthy down-time for the turbomachine, is costly from a labor standpoint, and requires extensive lifting and supporting equipment. Furthermore, the removal of the bladed rotor creates the potential for its damage during both removal and reinstallation.

It is also known in the prior art to use a fiberoptics cable which is insertable into a turbomachine such as a jet engine. It is possible to view, in succession, the stator vanes to inspect them for damage without requiring the disassembly of the engine. Such an apparatus is disclosed in U.S. Pat. No. 4,298,312 to MacKenzie, et al.

SUMMARY OF THE INVENTION

According to one aspect of the present invention, we provide a debris remover apparatus which eliminates the need to raise or remove the bladed rotor to locate and remove debris from a blade cascade. The apparatus provides a means by which individual blades in a blade cascade can be viewed to determine their structural integrity. The apparatus is portable and requires a single operator for its operation. The apparatus may be adapted for use in removing debris in various sizes of turbomachines.

According to another aspect of the present invention, we provide a debris remover apparatus which includes a housing attached to a flexible hollow hose. The housing is provided with an inspection opening in its wall. A first mounting means is attached inside the housing adjacent to the inspection opening. A grappling finger means is attached to the first mounting means with the finger means being mounted for controlled pivotal movement on the first mounting means so that the grappling finger means can be rotated, as desired, between a position inside of the housing to a position outside of the housing. The finger means is also mounted on the first mounting means for controlled translational movement adjacent to the inspection opening. The apparatus includes a second mounting means attached inside of the housing adjacent to the inspection opening. A fiberoptic viewing means is mounted inside of the housing and flexible hollow hose and has one end mounted on the second mounting means for controlled translational movement on the second mounting means. The moveable end of the fiberoptic viewing means is positioned on the second mounting means so that it points in a direction out of the inspection opening. The other end of the fiberoptic viewing means extends along the flexible hollow hose to the end thereof. In use, the housing and the flexible hollow hose can be manipulated by an operator to be positioned at a desired point near debris under visual control and observation. Thereafter, the grappling finger means can be moved out through the said inspection opening to engage the debris and to move the debris back into the inside of the housing means for removal from the turbomachine along with the apparatus.

According to still a further object of the present invention, I provide an improved mechanism for manually actuating the grappling finger means and viewing means in the disclosed apparatus. More specifically, according to one aspect of the present invention, the grappling finger means and viewing means may be manually manipulated by an operator through the use of cable which extend through the flexible hollow hose and can be manually controlled by an operator at the outer end of the flexible hose.

According to still a further aspect of the present invention, I provide a manually operable mechanism using pull cables to traverse the grappling finger means along the entire blade length of the turbomachine blade.

According to a further object of present invention, I provide a manually operable mechanism actuated by means of pull cables whereby the fiberoptic viewing means for viewing the turbomachine blades may be traversed the entire blade length for visual inspection.

It should be understood that other objects and advantages of the present invention will be readily appreciated by reference to the following detailed description when considered in connection with the accompanying drawings.

DRAWINGS

DESCRIPTION OF THE PREFERRED EMBODIMENT

Figure 1:
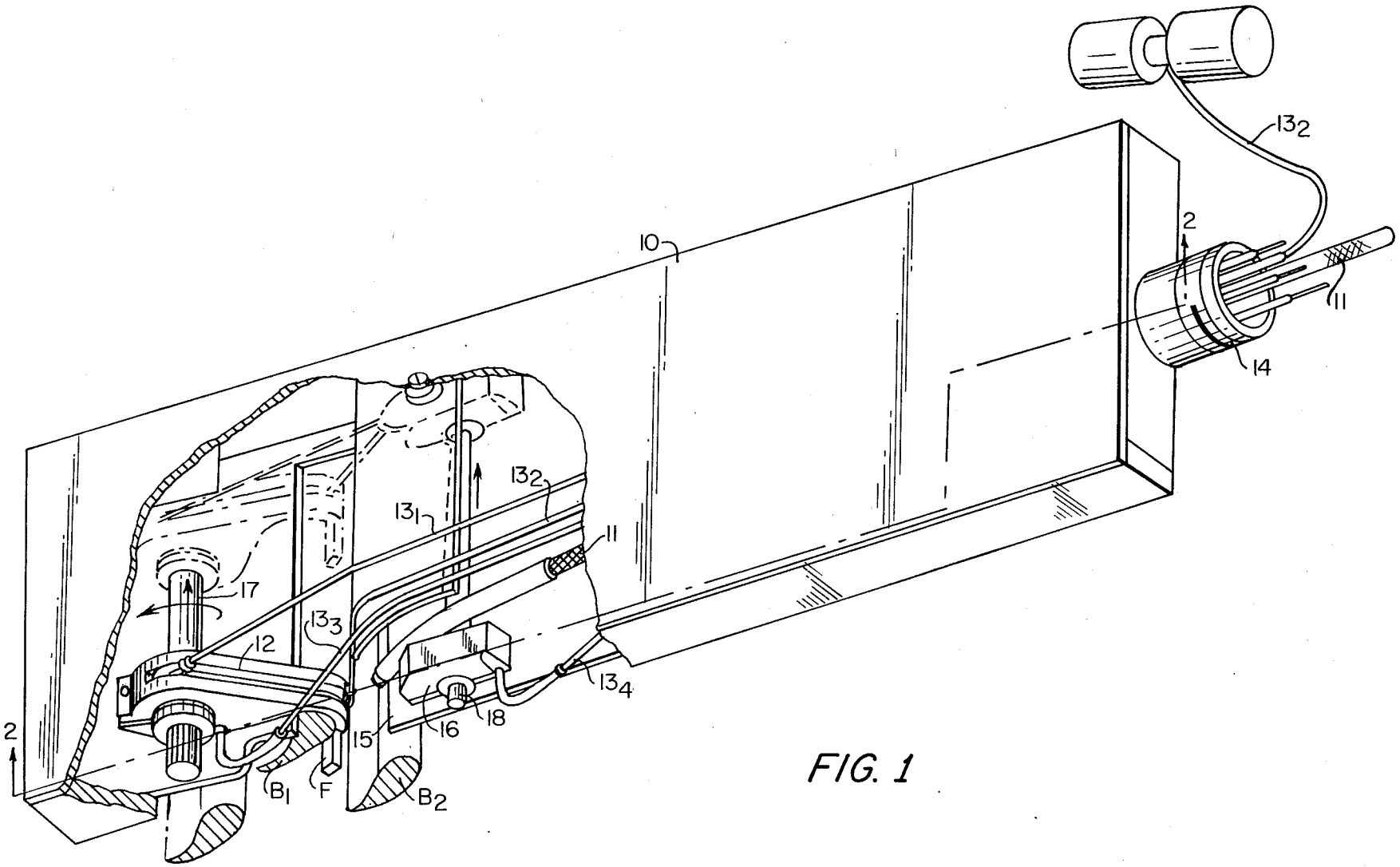
FIG. 1 is an isometric view with portions broken away and other portions shown in phantom, of a preferred embodiment of the debris remover according the present invention.

FIG. 1 is an isometric view with portions broken away for clarity and shows the present debris remover operatively associated with turbine blade. The debris remover apparatus generally includes an enclosure 10 for housing and carrying the viewing and grappling finger mechanism which are mounted near a viewing openng in the housing. The fiberoptic viewing mechanism for viewing turbine blades is generally denoted as 11. The grappling finger mechanism for dislodging and capturing debris inside of the housing is generally denoted as 12. The housing 10 serves as a containment for the debris once it is dislodged as described in more detail below. Pull cables $\mathbf{13}_1$ to $\mathbf{13}_4$ are provided for manually actuating the grappling finger and viewing mechanisms. The pull cables 13 extend from the viewing and grappling mechanisms to a remote location exteriorly of the debris remover. At that position they may be manually controlled by an operator. The grappling finger mechanism 12 is used for dislodging debris once it has been located. The grappling finger mechanism 12 is manually actuated by means of pull cables $13_1$ to $13_3$. The grappling finger mechanism is capable of traversing the entire blade length under control from cable $13_3$ and it is capable of being rotatably inserted and retracted from between adjacent blades in a blade cascade under the control from cables $13_1$ and $13_2$.

The fiberoptic viewing mechanism, generally denoted as 11, is used for viewing the blades and for visually locating debris which may be between the blades. The fiberoptic viewing mechanism is manually actuated by means of a pull cable $13_4$ which extends to the exterior of the debris remover. Under control by an operator, the fiberoptic viewing mechanism may be traversed by cable $13_4$ from one side of the housing 10 to the other so as to traverse the entire blade length.

The debris remover also includes a flexible hose 14 which is used for inserting and removing the housing 10 from the interior of the turbomechanism being inspected. The flexible hose 14 provides a way for manipulating the housing 10 as well as providing a protective cover for the various pull cables $13_1$ to $13_4$ and as a cover for the elongated fiberoptic viewer means 11.

Figure 2:
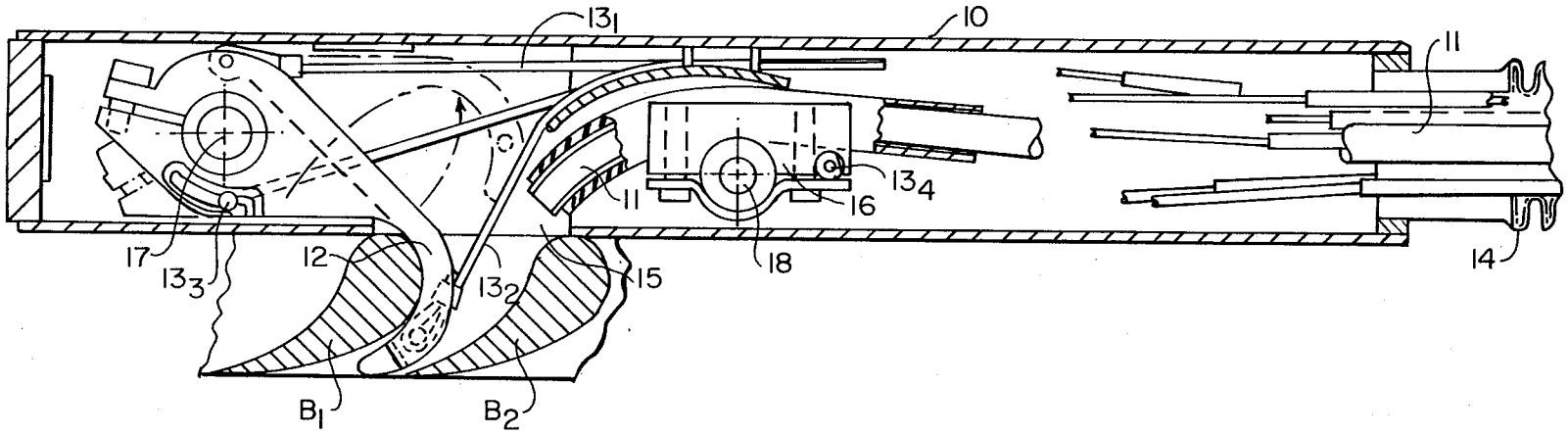
FIG. 2 is a cross-sectional view taken generally along line 2—2 of FIG. 1 and it shows further constructional details of the debris remover embodiment including a phantom view of the grappling finger means.

FIG. 2 shows a cross-sectional view of one end of the debris remover in association with turbine blades $B_1$, $B_2$ shown in cross section. The housing or enclosure 10 is used to house and carry the fiberoptic viewer and the grappling finger mechanisms 11 and 12. The housing 10 serves to contain the debris once it is dislodged from the turbo-machinery blades by the grappling finger. The debris is brought into the housing 10 by means of the inspection opening 15 adjacent to the viewer and grappling finger mechanisms. The housing 10 is attached to a long flexible hose 14 which is used to position the housing once it is within the turbomachine. Only a small portion of the flexible hose 14 is depicted in the drawings FIGS. 1 and 2 and, obviously, the length of hose 14 is selected so as to be long enough to permit inspection of the turbomachines in questions.

The pull cables $13_1$ to $13_4$ are attached to the holder of 16 of the fiberoptic viewer mechanism and the grappling finger means 12 so that rotational and/or translational motion of these mechanisms can be achieved. The pull cables $13_1$ to $13_4$ are routed through the flexible hose 14 from the holder 16 and grappling finger means 12 to the operator on the exterior end of the flexible hose 14. The operator may manipulate the pull cables $13_1$ to $13_4$ so that the various portions of the apparatus can be remotely manually actuated.

The grappling finger means 12 is mounted so that it is capable of both translational and rotational motion on a shaft 17. Pull cables $13_1$ to $13_3$ are attached to the grappling finger means 12 so that it can be made to traverse the entire blade length and/or to be rotationally inserted between two adjacent turbine blades $B_1$ and $B_2$. The translational motion is controlled by pull cable $13_3$ which is separate from those used for rotational motion, namely $13_1$ and $13_2$, so that the two motions are independent. As best seen in FIG. 1, the grappling finger means 12 is mounted for translational motion along the axis of the shaft 17 as shown by the axial arrow. Furthermore, the grappling finger means 12 is rotationally mounted on shaft 17 so that it can rotate in the directions of the rotational arrow shown in FIG. 1.

The fiberoptic viewer 11 is attached to a holder 16 which is mounted for translational motion along a shaft 18 mounted within the housing 10. Pull cable $13_4$ is attached to the viewer holder 16 so that the fiberoptic viewer can be made to traverse the entire blade length along the axis of the shaft 18 so that viewing of the blade is possible. The fiber optic viewer and the grappling finger mechanisms described above are controlled by separate pull cables which are independently operable from outside the free end of hose 14.

The flexible hose 14 extending from the housing 10 serves as a protective cover for the elongated fiberoptic viewer 11 and for the various pull cables $13_1$ to $13_4$ which are used for manipulating the grappling finger means and fiberoptic viewer. Furthermore, the flexible hose 14 is of sufficient rigidity that it is used for positioning the housing 10 once it is in the turbomachine.

Having described the construction of the debris remover in connection with FIGS. 1 and 2 of the drawings, we now describe the operation of the apparatus in conjunction with turbomachinery. With the upper half of the turbomachine blade casing removed and the grappling finger 12 fully retracted into its housing 10, the debris remover apparatus is positioned by the operator between the stator and rotor blade rows of interest in the lower casing of the turbomachine. The operator then examines the region between adjacent stator or rotor blades for the presence of debris by observing the region through the fiberoptic viewer eyepiece (not shown) while actuating the pull cable $13_4$ to cause translational motion of the fiberoptic viewer within the housing 10. The eyepiece and pull cable ends are located beyond the end of the flexible hose 14 exteriorly of the turbomachine. The operator may index the debris remover device and its fiberoptic viewer from one group of blades to another by inserting the flexbile hose 14 into the turbomachine to cause the housing to advance inward by an amount proportional to the length of the hose inserted into the machine. The visual examining process is continued until debris is located. Once debris is located, the operator positions the grappling finger 12 either well above or well below the debris by actuating the pull cables which cause translational motion of the grappling finger adjacent to the viewing opening. The operator then fully inserts the grappling finger 12 between the turbine blades by actuating the pull cable $13_1$ which causes outward rotational motion to the grappling finger. The grappling finger 12 is then in an extended position through the inspection openings of the housing 10 as best shown in FIG. 2. As a next step, the operator positions the grappling finger 12 such that a flange F on the grappling finger is located directly behind the debris to be retrieved. The grappling finger can also be positioned by actuating the pull cable $13_3$ which causes translational motion of the grappling finger. After being properly located, the operator then rapidly retracts the grappling finger 12 into the enclosure thereby tossing or pushing the debris into the interior of the housing 10. The grappling finger is rapidly retracted by actuation of the pull cable $13_2$ which causes its rotational movement about the shaft 17. Once the debris has been contained inside of the housing 10, the operator can remove the apparatus from the lower half casing of the turbomachine by merely pulling on the flexible hose 14 and thereby removing the entire apparatus and debris from the turbomachine.

While we have shown and described a preferred embodiments of the present invention, it should be understood that modifications may be made in the construction and arrangement of parts without departing from the spirit and scope of the invention.

We claim:

1. A debris remover apparatus comprising:

a housing means including a flexible hollow hose, said housing means defining an opening;

first mounting means attached inside of said housing means adjacent to said opening, said first mounting means having an elongated first shaft disposed adjacent to said opening;

grappling finger means attached to said first mounting means, said finger means being mounted on said first shaft for controlled pivotal movement on said first shaft whereby a portion of said grappling finger means is rotatable between a position inside of said housing means to a position outside of said housing means, said grappling finger means also being mounted on said first shaft for controlled translational movement along the axis of said first shaft;

second mounting means attached inside of said housing means adjacent to said opening, said second mounting means having an elongated second shaft disposed adjacent to said opening;

fiberoptic viewing means in said housing means and having one end mounted on said second mounting means, said one end being mounted for controlled translational movement along the axis of said second shaft, said one end of said fiberoptic viewing means being positioned with respect to said housing means so that it points in a direction out of said opening and the other end of said fiberoptic viewing means extends along said flexible hollow hose to the outer end thereof;

whereby said housing means can be manipulated by an operator to be positioned at a desired point near debris under visual control and, thereafter, said grappling finger means can be moved out through said opening to engage said debris and to move it into the inside of said housing means for removal.

2. The invention of claim 1 further comprising a first control means connected to said grappling finger means for causing said pivotal movement.

3. The invention of claim 2 further comprising a second control means connected to said grappling finger means for causing said translational movement.

4. The invention of claim 3 further comprising third control means connected to said fiberoptic viewing means for causing said translational movement.

5. The invention of claims 2, 3 or 4 wherein said first, second and third control means include flexible cables and respective guides which extend to the outer end of said flexible hollow hose for manual manipulation by an operator, as desired.

6. The invention of claim 1 wherein said grappling finger means has a flange in the outer rotatable end to facilitate engagement with debris on the outside of said housing.

7. The invention of claim 1 wherein said housing means includes a hollow housing.

8. The invention of claim 7 wherein said flexible hollow hose is sufficiently rigid that it can be used by an operator to manipulate and position said hollow housing.

9. The invention of claim 1 wherein said housing means includes a hollow housing defining an inspection opening in one wall and said hollow housing is connected to one end of said flexible hollow hose.

10. A debris remover apparatus comprising:

a housing, said housing having an opening therein;

a first shaft mounted in said housing adjacent to said opening;

grappling finger means mounted in said housing on said first shaft for translational movement along the axis of said first shaft and mounted on said first shaft for rotational movement between a position inside of said housing to a position outside of said housing;

a second shaft mounted in said housing adjacent to said opening;

fiberoptic viewing means mounted on said second shaft for translational movement along the axis of said second shaft, said fiberoptic viewing means being positioned adjacent to said opening so as to observe the position of debris which are adjacent to said opening.

* * * * *